United States Patent [19]

Bórresen et al.

[11] 4,214,797

[45] Jul. 29, 1980

[54] CASE STRUCTURE

[75] Inventors: Peter A. Bórresen, Vejle; Hans J. J. Greve, Billund, both of Denmark

[73] Assignee: A/S Modulex, Billund, Denmark

[21] Appl. No.: 888,363

[22] Filed: Mar. 20, 1978

[30] Foreign Application Priority Data

Mar. 24, 1977 [DK] Denmark ..... 1304/77

[51] Int. Cl.[2] ..... A47B 43/00

[52] U.S. Cl. ..... 312/257 R; 312/284; 312/111; 220/306; 16/DIG. 13

[58] Field of Search ..... 312/257 R, 284, 296, 312/138 R, 245, 111, 205, 204; 220/284, 285, 306; 16/DIG. 13

[56] References Cited

U.S. PATENT DOCUMENTS

| | | | |
|---|---|---|---|
| 1,291,794 | 1/1919 | Droste | 312/205 |
| 1,909,136 | 5/1933 | Thomas, Jr. | 312/257 R |
| 2,467,392 | 4/1949 | Kinberg | 220/284 |
| 3,148,103 | 9/1964 | Gallagher | 220/306 |
| 3,149,747 | 9/1964 | Burgess | 220/306 |
| 3,152,716 | 10/1964 | Feldhahn | 16/DIG. 13 |
| 3,223,278 | 12/1965 | Allen | 220/306 |
| 3,241,706 | 3/1966 | Monaco et al. | 312/284 |
| 3,613,931 | 10/1971 | Schifferle | 312/111 |
| 3,633,787 | 1/1972 | Katz | 220/284 |
| 3,942,679 | 3/1976 | Starr | 220/306 |

*Primary Examiner*—Victor N. Sakran

*Attorney, Agent, or Firm*—Stevens, Davis, Miller & Mosher

[57] ABSTRACT

In a case structure comprising a base member and a detachable cover having a pair of side walls adapted to be hingedly and interlockingly connected to the base member, the provision of a combined hinge and locking device comprising an elongated connecting member including an inwardly extending hook-shaped projection and an elongated, flexible and bendable, lengthwise extending hinge member intermediate the side walls and the connecting member. The base member includes a pair of lengthwise extending grooves for engagement with the hook-shaped projections of the cover and a pair of end walls.

5 Claims, 7 Drawing Figures

20
21
16
22
23
27
26
24
25
22
11
26
23
25
27
24
17
16
10
13
12

CASE STRUCTURE

This invention relates to a case structure and, more particularly, to a case having a base member and a transparent cover mounted on the base member, so as to define an enclosure for mounting a wall sign or similar panel.

In such case structures the cover is hinged on the base member so that the case may be opened and closed without removing the cover from the base member.

Moreover, it may also be desirable to mount the cover detachably on the base member, so as to provide for interchangeability of covers, e.g. of covers or lids of identical shape but having different colours, although the cover is generally made of a transparent material.

Finally, it is of particular importance to provide locking means for interlocking the cover with the base member, so as to make the space between the cover and the base inaccessible to unauthorised persons.

It is a principal object of the present invention to provide a combined hinge and locking device which provides for all the three above mentioned operations.

Figure 1:
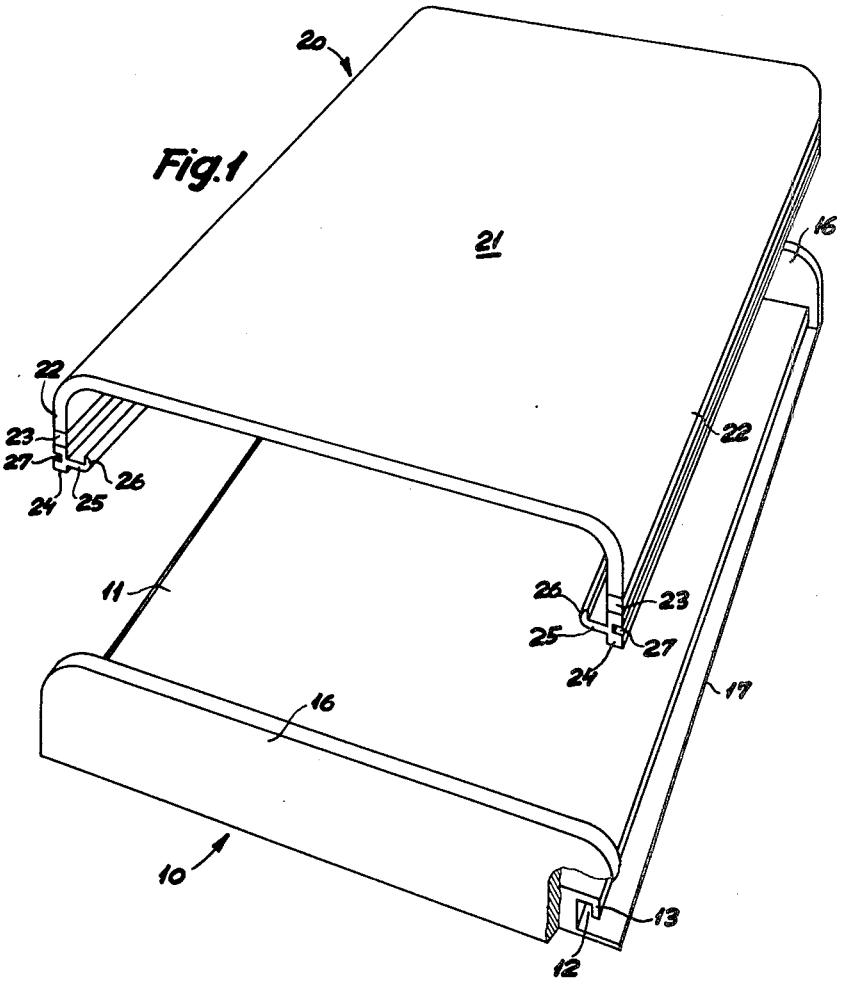
Figure 2:
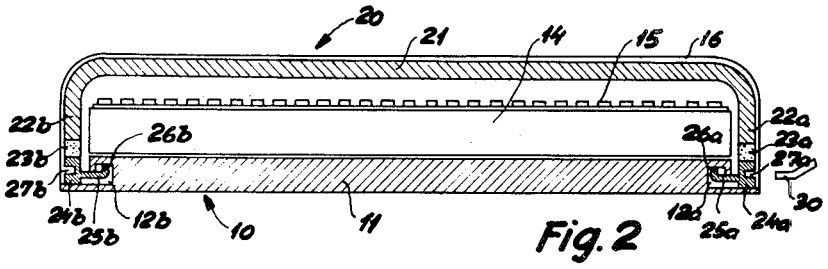
Figure 3:
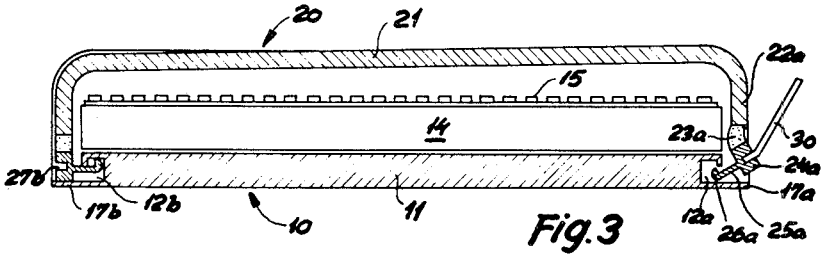
Figure 4:
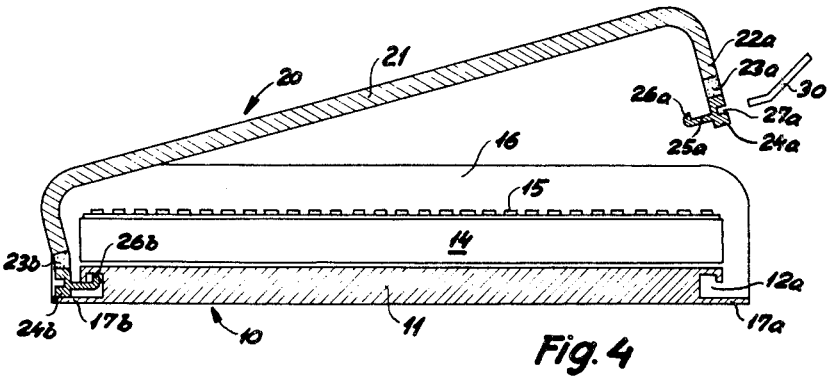
Figure 5:
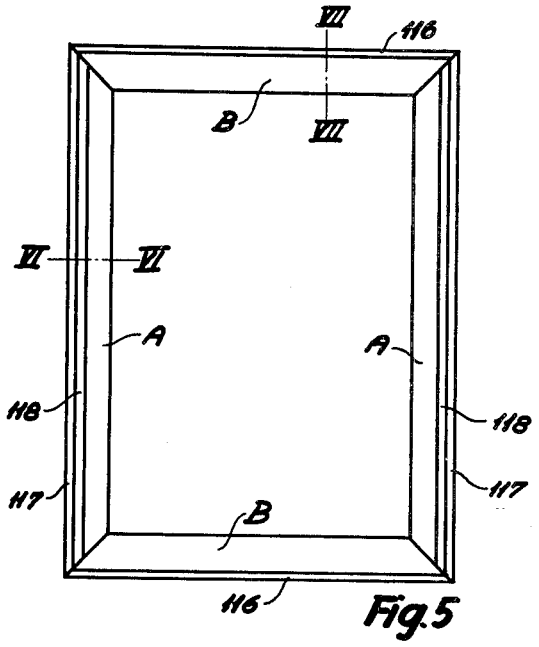
Figure 6:
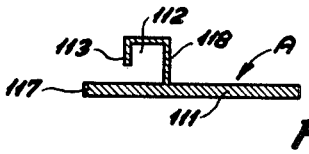
Figure 7:
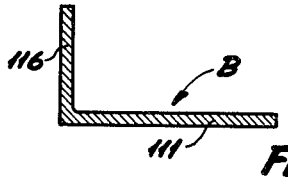

Other and ancillary objects of the invention will appear from the following description with reference to the drawings, wherein:

FIG. 1 is a perspective view showing a case structure having a base member and a cover separated therefrom, FIGS. 2, 3 and 4 are sectional views showing the cover in three different positions relatively to the base member, FIG. 5 is a plan view of a frame structure forming the base member of the case structure shown in FIGS. 1–4, FIG. 6 is a sectional view taken on the line VI—VI of FIG. 5, and FIG. 7 is a sectional view taken on the line VII—VII of FIG. 5.

In the embodiment shown in FIGS. 1–4 of the drawings, 10 designates a base member of the case structure and 20 designates a cover adapted to be hingedly, detachably and interlockingly associated with the base member.

In FIGS. 1–4 the base member is a rectangular plate 11 provided with lengthwise extending grooves or channels 12 along a pair of oppositely disposed sides. The upper edges of the plate 11 are provided with downwardly projecting ledges 13, so as to define substantially semi-tubular channels 12. A panel or board 14 is mounted on the upper face of the plate 11, and the top face of this panel may be provided with a plurality of studs 15 for mounting interchangeable elements (not shown) on the panel 14. The plate 11 is further provided with a pair of upwardly projecting end walls 16 disposed at right angles to the sides 17 adjacent the grooves 12. The base plate 11 may be made of any suitable material, such as wood, metal or a thermoplastic material.

The cover 20 comprises a substantially plane top surface 21 and a pair of downwardly projecting side walls 22. Preferably, this cover is made of a sheet of transparent acrylic material, in which the side walls 22 are formed by heating and bending the sides of the sheet. In each of the side walls the end face thereof is firmly attached to an elongated hinge member 23 comprising a strip made of an elastic, bendable material, such as any suitable elastomer. Each hinge member 23 is in turn firmly attached to an elongated connecting member 24 forming the lower edge of the side wall.

Each of the connecting members 24 is provided with an inwardly extending, substantially hook-shaped projection 25,26 adapted to engage the grooves 12 and ledges 13 of the base plate 11, as shown in FIGS. 2–4. Slots or recesses 27 are formed in the outer faces of the connecting members 24 for insertion of a tool 30 providing a lever for bending the hinge member 23 outwardly, as shown at **22*a* of FIG. 3, thereby disengaging the projections 25,26 from the grooves 12**.

It will be noted that, in FIGS. 2, 3 and 4, all reference numbers referring to the side walls are marked by index "a" to the right and by index "b" to the left of the Figures.

Thus, the combination of the side walls 22 with the hinge members 23 and the connecting members 24 constitutes a combined hinge and locking device providing for complete interlocking of the cover 20 with the base member 10, as shown in FIG. 2, and for opening of the case, as shown in FIG. 4. In this position, the side wall **22*a* is lifted from the base plate 11 by turning the other side wall 22*b* relatively to its connecting member 24*b* through elastic deformation of the hinge member 23*b*. Moreover, this device also enables the cover 20 to be completely removed from the base member 10, as shown in FIG. 1**, by disconnecting both side walls of the cover from the base plate.

In the embodiment shown in FIGS. 5–7, the base member is a rectangular frame structure comprising two pairs of frame members A and B, preferably made by extrusion of aluminium profiles.

In this embodiment, the lengthwise extending frame members A are profiles, as shown in FIG. 6, having a bottom flange 111 and a projection 118 extending upwardly therefrom. This projection is shaped substantially as an inverted L defining a lengthwise extending channel 112 and a downwardly extending ledge 113 corresponding to the grooves 12 and ledges 13 of FIGS. 1–4. One side 117 of the flange 111 corresponds to the side 17 of FIGS. 1–4.

The frame members B, as shown in FIG. 7, are angular profiles having a bottom flange 111 and an upwardly extending flange 116 defining end walls 116 corresponding to the end walls 16 of FIGS. 1–4.

The assembly of the frame members A and B may be made in any conventional manner and forms no part of the present invention. Accordingly, assembly means, such as auxiliary projections, grooves and angular connecting pieces, have been omitted in FIGS. 5–7 of the drawings.

Thus, the frame structure of FIGS. 5–7 constitutes a modification of the base member 11 of FIGS. 1–4 including grooves 112 for engaging the connecting members 24 of the cover, and end walls 116 for closing the space between the cover and the base member of the case.

In the drawings, the recesses 27 of FIGS. 1–4 in the connecting members 24 are shown as lengthwise extending slots adapted to receive the end of a tool, such as a lever 30. It will be understood, however, that these recesses 27 may alternatively be shaped as key holes, in which case the tool 30 is a corresponding key.

While the case structure according to the present invention is pre-eminently intended for use as a wall cabinet for mounting panels, such as sign boards, planning boards or the like,, it will be understood that it can readily be adapted to other uses, such as chests, coffers and suchlike boxes provided with detachable covers or lids.

What we claim is:

1. An assembly for mounting a panel in a transparent case structure comprising a substantially flat and rigid base member for supporting the panel, a cover, said base member defining a pair of inwardly extending, longitudinal channels along oppositely disposed sides thereof and having downwardly projecting ledges extending lengthwise adjacent the channels, to form therewith substantially recesses which are hook-shaped in cross section, said cover comprising a rectangular plate made of a transparent, substantially rigid material and having a pair of downwardly projecting side walls along opposite sides thereof, the side walls each including a connecting member extending parallel and adjacent the lower edge of the respective side wall and having an inwardly extending, substantially hook-shaped projection adapted to interlockingly engage one of the hook-shaped recesses in the base member, a flexible and bendable, lengthwise extending hinge member interconnecting said connecting member and the side wall of the cover whereby the cover is adapted to be detachably and hingedly connected to the base member.

2. A structure, as claimed in claim 1, and including a combined hinge and locking device in which the connecting member is provided with a recess at the outer face thereof for interengagement with a tool adapted to bend the flexible hinge member outwardly from the side of the base member to disconnect the side walls of the cover from the channels of the base member.

3. A case structure, as claimed in claim 1, in which the base member comprises a pair of upwardly extending end walls perpendicular to the side walls of the cover, so as to form an enclosure defined by said side walls and end walls.

4. A case structure, as claimed in claim 1, in which the base member is a frame structure comprising two pairs of frame members, one pair of said frame members having lengthwise extending grooves, and the other pair of frame members having upwardly extending flanges defining a pair of end walls of the base member.

5. A frame structure, as claimed in claim 4, and including:

(A) one pair of profiled frame members comprising a bottom flange and a projection extending upwardly therefrom, said projection being shaped substantially as an inverted L, and (B) a second pair of frame members comprising a bottom flange and an end flange disposed at right angle relatively to the bottom flange, the pair (A) defining grooves extending in the lengthwise direction and the pair (B) defining end walls extending in the transverse direction of the frame.

* * * * *